United States Patent [19]

Harding et al.

[11] 4,029,383

[45] June 14, 1977

[54] ELECTRICAL CONNECTORS

[75] Inventors: John Patrick Harding, Bushey; David Sydney Butler, Hassocks, both of England

[73] Assignee: The Post Office, London, England

[22] Filed: May 19, 1976

[21] Appl. No.: 687,759

Related U.S. Application Data

[63] Continuation of Ser. No. 524,985, Nov. 18, 1974, abandoned.

[30] Foreign Application Priority Data

Nov. 20, 1973 United Kingdom ..... 53826/73
May 17, 1976 United Kingdom ..... 22037/76

[52] U.S. Cl. ..... 339/97 R; 339/274
[51] Int. Cl.[2] ..... H01R 7/06
[58] Field of Search ..... 339/95–99, 339/239, 268, 274; 24/132 AC, 134 R; 174/84 S, 87, 88 S, 94 S

[56] References Cited

UNITED STATES PATENTS

| | | | |
|---|---|---|---|
| 1,921,840 | 8/1933 | Recen | 339/95 B |
| 2,125,203 | 7/1938 | Schanbacher | 339/239 |
| 2,908,884 | 10/1959 | Wirsching | 339/99 R |
| 3,873,178 | 3/1975 | Galli | 339/274 |

FOREIGN PATENTS OR APPLICATIONS

| | | | |
|---|---|---|---|
| 1,149,685 | 4/1969 | United Kingdom | 339/97 R |

*Primary Examiner*—Roy Lake
*Assistant Examiner*—Neil Abrams
*Attorney, Agent, or Firm*—Hall & Houghton

[57] ABSTRACT

An electrical connector comprises a first body rotatably mounted in a hollow second member. In one form, the second member is a hollow cylinder and the first member has a cylindrical portion to fit the cylinder and a tapered portion of snail-cam cross-section to clamp a conductor inserted between the tapered portion and the bore of the second member. Clamping is achieved by relative rotation of the members, a recess for an Allen key being provided in the first member, and projections or serrations are provided to rupture insulation. In a second form, the second member is frustoconical and the first member is correspondingly tapered. Also described, are an end-cap for the connector with projection-and-recess means to retain it in place, and the use of projections and corresponding recesses for axial location of the members and limitation of the degree of rotation. A double-ended connector is also shown.

7 Claims, 11 Drawing Figures

ELECTRICAL CONNECTORS

This is a continuation of application Ser. No. 524,985 filed Nov. 18, 1974, now abandoned.

This invention relates to electrical connectors.

It is an object of the invention to provide an improved electrical connector.

The present invention provides an electrical connector comprising:

a first member having a body portion with a bore extending from one end thereof, a second member having a body portion at least partly disposed in the bore of the first member, a surface portion of the bore of the bore of the first member co-operating with a surface portion of the body of the second member so that the members are arranged for relative rotation, another surface portion of the bore of the first member co-operating with another surface portion of the body of the second member to define a cavity extending parallel to the axis of rotation from the said one end and into which a conductor can be inserted, and means to enable the members to be rotated relative to each other to cause said another surface portions to close on the conductor and establish a generally radial clamping force thereon.

The bore can be a cylindrical bore and the second member can have a cam-shaped portion defining said another surface portion and have a cylindrical portion corresponding in diameter to the bore defining the first mentioned surface portion. The cam-shaped portion can be tapered.

Alternatively, the bore can be a conical bore and the second member can have a cam-shaped portion defining said another surface portion and have a conical portion corresponding in taper to said bore defining the first mentioned surface portion. Projections (such as serrations or knurls) can be provided on at least one of said members to project into said cavity so as to prevent circumferential movement of a conductor on relative rotation of the members; the projections may further assist penetration of the insulation of a conductor and promote good electrical contact with a conductor.

The means to enable the members to be rotated can be means to receive a key or other tool.

An end cap adapted to fit on the said one end of said first members and having an aperture therein to co-operate with said cavity can be provided. Retaining means to retain the end cap on the first member can comprise a projection co-operating with means defining a recess to receive the projection.

Retaining means on the first member engaging retaining means on the second member can be provided to retain the second member axially with respect to the first member.

Movement limiting means can be provided on the first member to engage movement limiting means on the second member to limit the degree of relative rotation of the members.

The retaining means and the movement limiting means can comprise a projection on one member and means defining a recess on the other member.

The movement limiting means can alternatively comprise a projection on one member and a transverse surface on the other member.

Embodiments of the invention enable some types of conductor to be clamped to give a sound electrical connection without prior removal of insulation from the conductor.

In a preferred form of connector the second and first members are respectively a cam-shaped clamping member rotatably disposed within a cylindrical body.

To provide a smooth transition between the clamped portion of a conductor and the unclamped portion emerging from the connector, the radial clearance between the first and second members may vary axially of the cylinder; this may be achieved by, for example, a taper of the first member.

Opening and closing of the connector may be effected by means of a simple tool such as an Allen key, the second member thus needing only a small hexagonal-section recess to accommodate the tool. Preferably the first member is provided with an external portion of non-circular cross-section where it can be gripped or mounted against rotation during opening and closing of the connector.

The connector may be in the form of a terminal for mounting on equipment, or may be double-ended for connecting two conductors to each other.

In another preferred form of connector the second member is a cam-shaped clamping member and the first member is a tapered body.

Preferably the body is of frusto-conical form. Preferably also the body has generally axial internal projections.

Preferably retaining means are provided for positively retaining the cap on the body of the connector. The retaining means may comprise recesses and co-operating projections. For example a body of circular cross-section may have a circumferential groove and a rim of the end cap may have one or more projections co-operable with the groove; there may be a single projection on the cap, the projection being in the form of a circumferential bead.

The connector can include retaining means for retaining the second member axially with respect to the first member. For example a circumferential groove on one member may be engaged by a projection on the other member.

The connector can include limiting means for limiting said relative rotation. For example an arcuate groove in one member may be engaged by a projection on the other member. Or a transverse surface on an end of one member may be engaged by a projection on the other member.

The functions of retaining means and limiting means may be combined, as in the case of an arcuate groove in a side of one member and a co-operating projection on the other member.

By way of example only, certain illustrative embodiments of the invention will now be described with reference to the accompanying drawings, in which.

Figure 4:
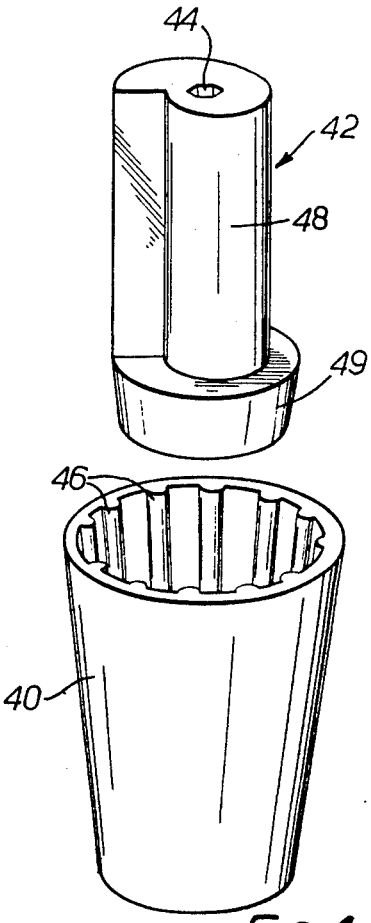
Figure 3A:
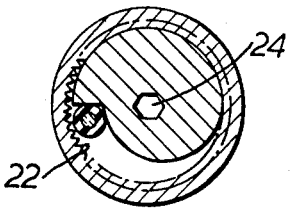
Figure 3B:
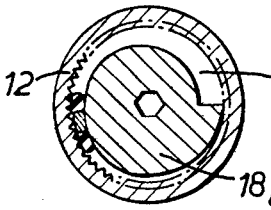
Figure 5:
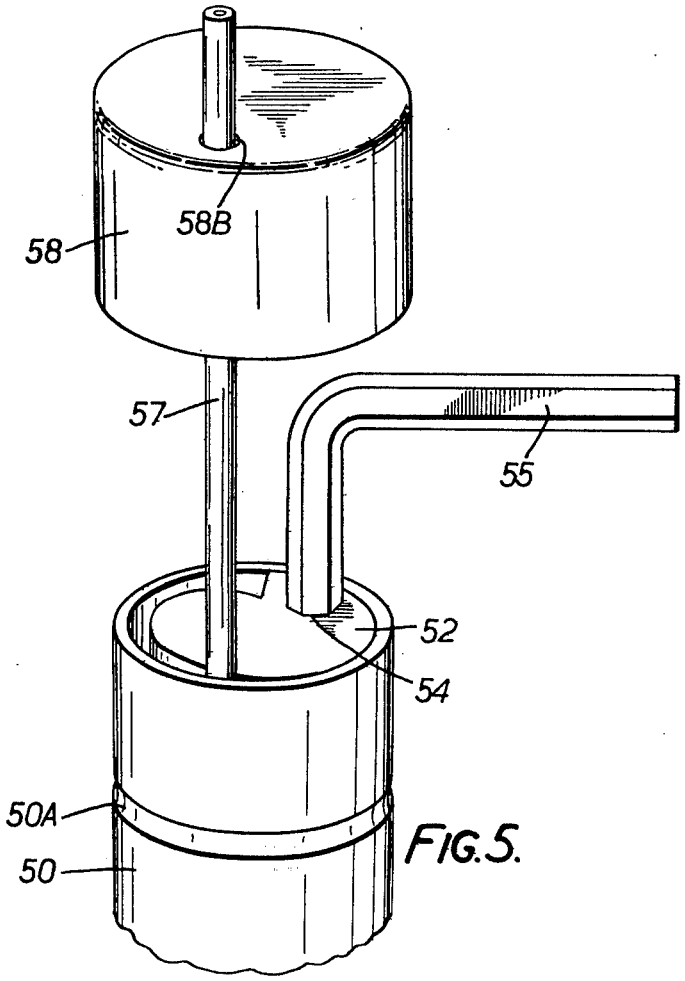
Figure 2A:
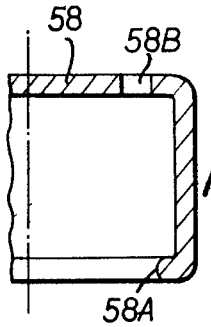
Figure 6:
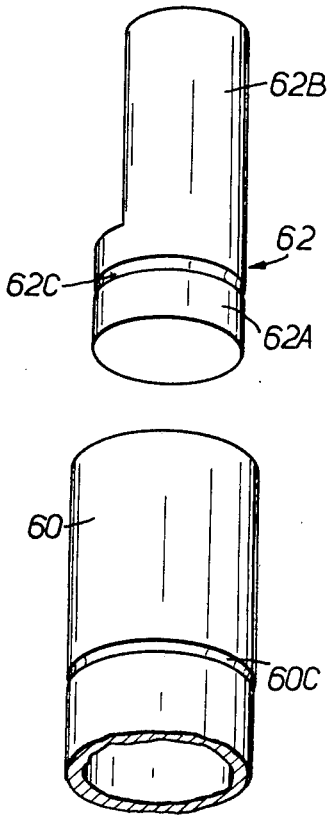
Figure 7:
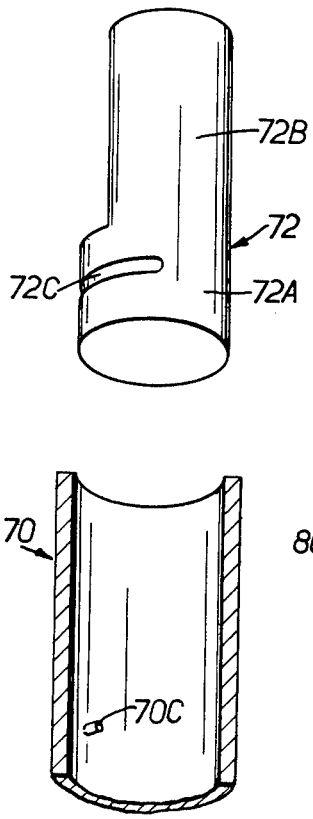
Figure 8:
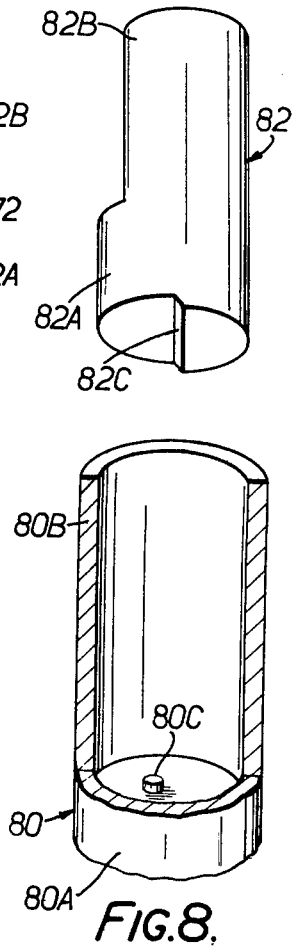
Figure 8A:
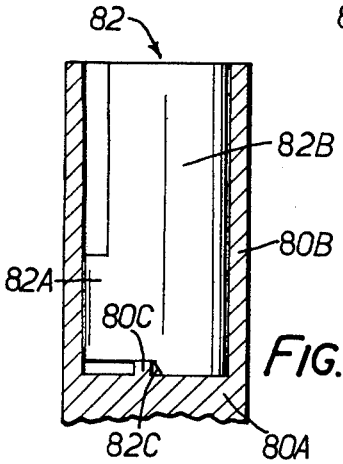

FIGS. 3A and 3B are end elevations of the connector showing a conductor wire respectively before and after clamping, FIG. 4 is an exploded view of a connector embodying the invention, FIG. 5 is a partly exploded view of another connector embodying the invention, and FIG. 2A is a fragmentary sectional elevation of a part of this connector, FIG. 6 is an exploded view of another connector embodying the invention, FIG. 7 is an exploded view, partly in section, of another connector embodying the invention, and FIG. 8 is an exploded view, partly in section, of another connector embodying the invention, and FIG. 8A is a fragmentary sectional elevation of a part of this connector.

Figure 1:
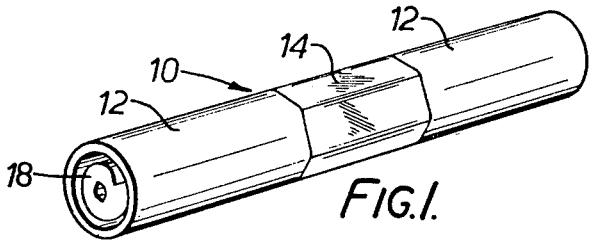
FIG. 1 is a perspective view of a double-ended electrical connector.
Figure 2:
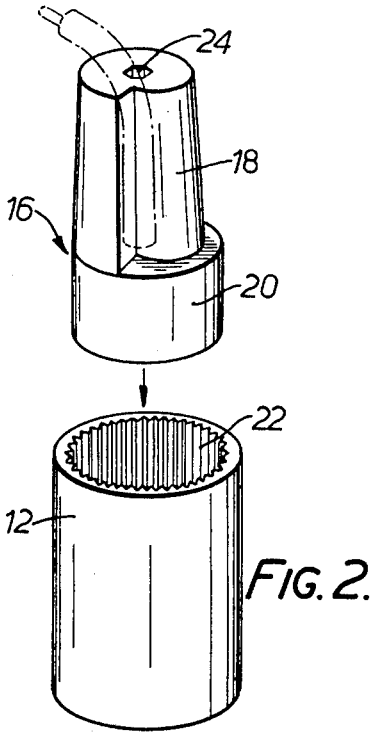
FIG. 2 is an exploded perspective view of one end of the connector.

Referring to the FIG. 1, the connector consists of a phosphor bronze body 10 having a cylindrical portion 12 at each end and a solid square-section central portion 14 which can be gripped or mounted to prevent rotation of the body. Rotatably disposed within each of the cylindrical portions 12 of the body is a phosphor bronze clamping member 16 having a tapered snail cam portion 18 and a cylindrical bearing portion 20. That part of each cylindrical portion 12 adjacent a cam portion 18 is provided with serrations 22. In the outer end of each clamping member 16 is a recess 24 of hexagonal cross-section.

In use, a wire to be connected is inserted between the serrations 22 and that part of the cam 18 having smallest radius (see FIG. 3A). An Allen key is inserted in the recess 24 and used to turn the clamping member 16 so that the wire is progressively crushed and its insulation ruptured (see FIG. 3B). The making of the connection is thus extremely quick and simple. The serrations 22 prevent circumferential movement of the conductor when the clamping member 16 is rotated. The serrations further assist the establishment of good electrical contact between the conductor and the connector.

The elasticity of the phosphor bronze components of the connector enables a good electrical contact to be maintained for long periods, although it will of course be appreciated that other suitable materials could be employed.

The connector can be made very compact and a number of connectors can therefore be accommodated in a small space. Further, the use of a simple tool such as a Allen key for closing of the connector enables this operation to be carried out in confined spaces in which many types of connector would be inaccessible.

It has been found that with a connector such as that described a connection may be made and unmade a number of times without loss of electrical integrity. Further, the connector locks well against vibration.

All the connectors illustrated in FIGS. 4 to 8 are in the form of terminals for mounting on equipment so that conductors can be connected to that equipment, but it will be appreciated that the connectors may be made in double-ended configuration for joining two conductors end-to-end.

Referring to FIG. 4 the connector comprises a frusto-conical body 40 within which a clamping member 42 is rotatable. The clamping member has a snail cam portion 48, a frusto-conical bearing portion 49 and an axial recess 44 of hexagonal section into which an Allen key can be inserted to turn the member. The portion 49 has the same taper as the body 40. The inner surface of the body 40 has axial ribs 46 so that when a conductor is inserted axially between the body 40 and the clamping member 42 and then the latter is turned to clamp the conductor the conductor will be held relative to the body and will not move round with the clamping member. Because the body 40 is tapered, crushing of a conductor will vary from a maximum at the end of the conductor to little or nothing at the point of emergence of the conductor from the connector. Thus the danger of the conductor fracturing adjacent the connector is greatly reduced.

Referring to FIG. 5 the conductor comprises a cylindrical body 50 within which a snail cam clamping member 52 is disposed. Like the clamping member shown in FIG. 4, the member 52 has a hexagonal recess 54 and an Allen key 55 is shown disposed therein. A conductor 57 to be clamped in the connector is disposed in the manner illustrated and the member 52 then turned by means of the key 55 until any insulation around the conductor has been ruptured and a sound electrical connection has been established. The key 55 is then removed.

To neaten the connector end and to protect the connector from corrosion, a cap 58, previously pushed onto the conductor 57, is pressed over the end of the connector so that an internal lip 58A (FIG. 5A) on the rim of the cap engages a circumferential groove 50A on the body 50. The cap is prefilled with a quantity of grease which, on assembly, seals with the body and preserves the electrical connection previously made. A hole 58B (FIG. 5A) in the cap admits the conductor 57.

Referring to FIG. 6 the conductor comprises a cylindrical body 60 within which a clamping member 62 is rotatable. The clamping member has a lower bearing portion 62A of circular cross-section and an upper clamping portion 62B of snail cam section Like the previously described clamping members the member 62 has a tool recess in its upper surface (not shown).

The connector differs from the previous embodiments in that there is provision for retaining the member 62 axially within the body 60. A circumferential groove 620 in the member 62 is engageable with a circumferential bead (not shown) on the inside of the body 60. The bead is formed by embossing the body as at 60C.

Referring to FIG. 7 the connector comprises a cylindrical body 70 within which a clamping member 72 is rotatable. The latter is generally similar to the member shown in FIG. 6 and has a bearing portion 72A and a snail cam portion 72B. However a groove 72C in the bearing portion 72A extends only part-way around the member and, on assembly, engages a radial peg 70C on the inside of the body. Thus the groove 72C and peg 70C not only locate the member 72 axially with respect to the body 70, but also limit angular movement of the member 72 when the latter is turned to clamp a conductor. It will be appreciated that for a given combination of connector and conductor dimensions the limit on angular movement can enable the clamping force applied to a conductor to be predetermined.

Referring finally to FIG. 8 the connector comprises a cylindrical body 80 having a lower solid portion 80A and an upper tubular portion 80B. A clamping member 82 having a bearing portion 82A and a snail cam portion 82B is disposable in the tubular portion 80B of the body as shown in FIG. 8A. In this embodiment rotation of the clamping member 82 relative to the body 80 is limited by engagement of an axial peg 80C on the body with a transverse axial surface 82C on the member 82.

The connectors herein described enable very efficient use to be made of a small quantity of material in storing energy when a conductor is clamped. The advantage of stored energy is that the integrity of electrical contact can be maintained for long periods despite relaxation or movement of components. The following example is based on a connector whose body and clamping member are of phosphor bronze and a copper conductor wire of 0.020 in. (without insulation). Assuming crushing to 0.010 in. at the tip of the wire, zero crushing at the point of emergence of the wire from the connector, and a length of connection of 0.28 in., the force required is $$0.5 \times 0.020 \times 0.28 \times 3000 = 84 \text{ lbf.}$$

(3000 = crushing strength of annealed copper).

For a tubular phosphor bronze body of 0.030 in. wall thickness it can be shown that a point load of 84 lbf. will deflect the wall through 0.001 in. A tube wall thinner than 0.030 in. would distort permanently under such a load and thus fail to store maximum energy, while a thicker tube wall, e.g. 0.050 in., would be much stiffer and permit a deflection of only about 0.00025 in. thus storing only 25% of the energy stored by the 0.030 in. wall; thus in these circumstances a wall of 0.030 in. gives optimal electrical permanence.

The described connectors make very efficient use of a small quantity of material in storing energy on clamping of a wire and are therefore especially suited to the jointing of aluminium conductors.

Stranded conductors can be jointed by use of appropriately larger sizes of connector and large conductors (otherwise too large for a particular connector) can be stripped of insulation prior to jointing.

We claim:

1. An electrical connector comprising:

a body member having an inner wall defining an elongate cylindrical bore of circular cross-section, said bore extending into the body member from an outside surface thereof, an elongate member located within said body member and surrounded by said inner wall, a cylindrical boss of circular cross-section corresponding to the bore diameter at one end of said elongate member mating with the inner wall of said body member at a location remote said outside surface, a tapered shank portion of snail cam cross-section on said elongate member extending from said boss to the other end of said elongate member adjacent said outside surface, the cross-sectional area of said snail cam decreasing progressively towards said other end of said elongate member, and means to rotate the body member and elongate member relative to each other.

2. An electrical connector comprising:

a body member having an inner wall defining an elongate conical bore of circular cross-section, said bore tapering into the body member from an outside surface thereof, an elongate member located within said body member and surrounded by said inner wall, a frusto-conical boss at one end of said elongate member conforming to the shape of the bore and mating with the inner wall of said body member at a location remote said outside surface, a cylindrical shank portion of snail cam cross-section on said elongate member extending from said boss to the other end of said elongate member adjacent said outside surface, the cross-sectional area of said snail cam being substantially constant along said shank portion, and means to rotate the body member and elongate member relative each other.

3. An electrical connector comprising:

a thin walled resiliently deformable tubular member of circular cross-section having axial serrations on the inside surface thereof, an elongate member located within said tubular member and surrounded by the inside surface of said tubular member, a mounting boss of circular cross-section at one end of said elongate member corresponding to the shape of the bore and mating with the inside surface of said tubular member over an axial length thereof to mount said elongate member for rotation relative to said tubular member, a shank portion of snail cam cross-section on said elongate member extending axially from said mounting boss to the other end of said elongate member in spaced relation to the inside surface of said tubular member, and means to rotate said tubular member and said elongate member relative to each other.

4. A connector as set forth in claim 3, wherein said means to rotate said tubular member and said elongate member relative to each other comprises means in said other end of said elongate member defining a non-circular section cavity extending into said elongate member and spaced from the periphery of said other end of said elongate member.

5. An electrical connector comprising:

a body member having an inner wall defining an elongate bore of generally circular cross-section, said bore extending into the body member from an outside surface thereof, an elongate member located within said body member and surrounded by said inner wall, a fixed-axis mounting for said members comprising a mounting boss located at one end of said elongate member and having an outer surface comforming to the shape of said bore over a length thereof, said boss mating with said inner wall at a location remote said outside surface to provide a fixed axis of relative rotation for said body member and said elongate member, a free-standing end portion on said elongate member extending from said boss to the other end of said elongate member adjacent said outside surface, said end portion having an outer wall arranged in free-standing spaced relation to said inner wall over a length of said bore extending from said outside surface, a major portion of said outer wall being in the form of a convex curve whose radius in at least one region thereof approximates to the radius of the bore and decreases smoothly away from said region to define a cavity extending around the axis of said elongate member, open at said outside surface, extending into said body member, and having a radial dimension decreasing progressively in a circumferential direction, and means to rotate said body member and said elongate member relative to each other to exert a radial clamping force on a wire inserted in said cavity.

6. A connector as set forth in claim 5, wherein said inner wall defines elongate projections running along the length of said bore.

7. A connector as set forth in claim 5, further including at said location remote said outside surface, a projection on one of said members located in means defining a circumferential groove in the other of said members, said groove having side walls co-operating with said projection to maintain axial alignment of the members, and end walls co-operating with said projection to limit the degree of relative rotation of said members.

* * * * *